US007351061B2

(12) United States Patent
Hull et al.

(10) Patent No.: US 7,351,061 B2
(45) **Date of Patent: *Apr. 1, 2008**

(54) PATTERN TESTING BOARD AND SYSTEM

(75) Inventors: George R. Hull, Tigard, OR (US); Robert M. O'Loughlin, Sr., Portland, OR (US); Terry P. O'Loughlin, Portland, OR (US)

(73) Assignee: Lightshot Systems, Inc., Portland, OR (US)

( * ) Notice: Subject to any disclaimer, the term of this patent is extended or adjusted under 35 U.S.C. 154(b) by 160 days.

This patent is subject to a terminal disclaimer.

(21) Appl. No.: 11/181,118

(22) Filed: Jul. 13, 2005

(65) Prior Publication Data

US 2007/0020586 A1 Jan. 25, 2007

Related U.S. Application Data

(63) Continuation of application No. 10/919,551, filed on Aug. 16, 2004, now Pat. No. 6,960,085, which is a continuation of application No. 10/184,847, filed on Jun. 27, 2002, now Pat. No. 6,780,014, and a continuation-in-part of application No. 09/222,337, filed on Dec. 28, 1998, now abandoned, which is a continuation-in-part of application No. 09/019,152, filed on Feb. 6, 1998, now Pat. No. 6,068,484, which is a continuation of application No. 08/753,537, filed on Nov. 26, 1996, now Pat. No. 5,716,216.

(60) Provisional application No. 60/309,360, filed on Aug. 1, 2001.

(51) Int. Cl.
*F41G 3/26* (2006.01)

(52) U.S. Cl. ..... 434/21; 434/22; 273/365; 273/371; 463/52

(58) Field of Classification Search ..... 434/11, 434/16, 19, 20, 21; 273/22, 365, 371; 463/51, 463/52, 53
See application file for complete search history.

(56) References Cited

U.S. PATENT DOCUMENTS 3,633,285 A 1/1972 Sensney (Continued)

FOREIGN PATENT DOCUMENTS

ES 2020398 8/1991

(Continued)

*Primary Examiner*—Kurt Fernstrom
(74) *Attorney, Agent, or Firm*—Law Office of Karen Dana Oster, LLC

(57) ABSTRACT

A pattern testing board is able to detect an emission beam such as a laser or light beam from a shooting system. A pattern testing board includes a plurality of paired emission beam sensors and hit indicators. Each emission beam sensor is responsive to a detected emission beam and each hit indicator signals the sensing of the emission beam by the associated emission beam sensor. Multiple pattern testing boards may be mounted together to provide a larger pattern testing system array. Further, an overlay with a representation thereon, a moving image display system, or a reflective moving image display system may be positioned in front of one or more pattern testing boards. Still further, the pattern testing board may be incorporated in a unique target system that includes the pattern testing board for determining the beam pattern emitted by the beam emitter, a level selection board for selecting a level of play, and a targeting game board having a plurality of targets.

14 Claims, 12 Drawing Sheets

U.S. PATENT DOCUMENTS 3,748,751 A 7/1973 Breglia et al.
3,811,204 A * 5/1974 Marshall et al. ..... 434/22
3,849,910 A 11/1974 Greenly
3,911,598 A * 10/1975 Mohon ..... 434/20
4,065,860 A * 1/1978 Linton et al. ..... 434/22
4,083,560 A 4/1978 Kikuchi et al.
4,150,824 A 4/1979 Villa
4,177,580 A 12/1979 Marshall et al.
4,195,422 A 4/1980 Budmiger
4,266,776 A 5/1981 Goldfarb
4,315,689 A 2/1982 Goda
4,398,722 A 8/1983 Morris et al.
4,478,581 A 10/1984 Goda
4,482,325 A 11/1984 Reimann
4,487,583 A 12/1984 Brucker et al.
4,533,144 A 8/1985 Juarez et al.
4,640,514 A 2/1987 Myllyla et al.
4,662,845 A 5/1987 Gallagher et al.
4,854,595 A 8/1989 Eichweber
4,898,391 A 2/1990 Kelly et al.
5,095,433 A 3/1992 Botarelli et al.
5,194,006 A 3/1993 Zaenglein, Jr.
5,281,142 A 1/1994 Zaenglein, Jr.
5,321,263 A 6/1994 Filo
5,417,573 A 5/1995 Cassiere, II et al.
5,437,463 A 8/1995 Fromm
5,716,216 A 2/1998 O'Loughlin et al.
5,785,592 A 7/1998 Jacobsen
6,007,429 A 12/1999 Lubniewski
6,012,980 A 1/2000 Yoshida et al.

FOREIGN PATENT DOCUMENTS

GB 2115708 A 9/1983

* cited by examiner

PATTERN TESTING BOARD AND SYSTEM

The present application is a continuation of U.S. patent application Ser. No. 10/919,551, now U.S. Pat. No. 6,960,085 filed Aug. 16, 2004. U.S. patent application Ser. No. 10/919,551 is a continuation of U.S. patent application Ser. No. 10/184,847, filed Jun. 27, 2002 (which issued as U.S. Pat. No. 6,780,014 on Aug. 24, 2004). U.S. patent application Ser. No. 10/184,847 claims the benefit under 35 USC Section 119(e) of U.S. Provisional Patent Application Ser. No. 60/309,360, filed Aug. 1, 2001. U.S. patent application Ser. No. 10/184,847 is a continuation-in-part application of U.S. patent application Ser. No. 09/222,337, filed Dec. 28, 1998 (now abandoned). U.S. patent application Ser. No. 09/222,337 is a continuation-in-part application of U.S. patent application Ser. No. 09/019,152, filed Feb. 6, 1998 (which issued as U.S. Pat. No. 6,068,484 on May 30, 2000). U.S. patent application Ser. No. 09/019,152 is a continuation of U.S. patent application Ser. No. 08/753,537, filed Nov. 26, 1996 (which issued as U.S. Pat. No. 5,716,216 on Feb. 10, 1998). The present application is based on and claims priority from these applications, the disclosures of which are hereby incorporated herein by reference.

BACKGROUND OF INVENTION

The present invention relates to a pattern testing board for use in a system for simulating shooting sports and for a pattern testing target board system.

U.S. Pat. Nos. 6,068,484 and 5,716,216 are directed to a system for simulating shooting sports including a non-projectile ammunition transmitter system that is retrofittable to any standard firearm having an ammunition chamber, a barrel, and a firing pin and a self-contained receiver system. The transmitter system includes an actuating beam cartridge and an adjustable beam choke. The beam cartridge includes a first actuating beam emitter responsive to the firing pin. The beam choke includes a second emission beam emitter responsive to the first actuating beam. The receiver system is a self-contained reusable target having beam sensors and hit indicators. The beam sensors are "triggered" when the emission beam "hits" or is "sensed by" the beam sensors. When the beam sensors sense the emission beam, they cause the hit indicators to indicate that the target has been "hit" by the emission beam. The target may also include at least one triggering motion detector that detects a triggering motion that is associated with the target being launched into the air.

Target boards have been used to test non-projectile output from firearms. Exemplary target boards are disclosed in U.S. Pat. No. 3,811,204 to Marshall (the "Marshall reference"), U.S. Pat. No. 4,195,422 to Budmiger (the "Budmiger reference"), U.S. Pat. No. 3,911,598 to Mohon (the "Mohon reference"), U.S. Pat. No. 4,640,514 to Myllyla et al. (the "Myllyla reference"), and U.S. Pat. No. 4,662,845 to Gallagher et al. (the "Gallagher reference").

The Marshall reference is directed to a programmable laser marksmanship trainer that contains a screen for viewing a program of slides of different battle scenes. A plurality of light detectors is supported behind the screen in a matrix. In each image, one or more targets are projected onto the screen, and are oriented so that they coincide with one or more of the light detectors. Each light detector is capable of being actuated by a laser, and when so actuated actuates an associated hit indicating lamp and cumulative hit counter. A common programming means is employed to simultaneously actuate a slide projector and a sequential detector switching means. In this manner, projected images and target areas located therein are varied by sequentially projecting slides and sequentially varying connected light detectors. In other words, the Marshall reference discloses that when any single laser beam hits a target, only a single detector will be activated. If a laser beam narrowly or widely misses the target, the detector remains in an inactive state.

The Budmiger reference is directed to a system for simulating weapon firing that includes a target device having a target image subdivided into regions with a detector situated in each region. The Budmiger reference discloses that indications of hits are first evaluated and coded in order to evaluate the target hits. Where the beam activates more than one sensor, the evaluation device assigns the hit to the higher valued sensor. Hits are then decoded and the results are displayed on a display unit or indicator remote from the target device. Thus, the Budmiger reference discloses that an evaluation of the relative accuracy of the hit is provided on a display device physically distant from the target device.

The Mohon reference is directed to a laser-type weapon fire simulation system that includes a holographic means for producing a three-dimensional image of a target and detector screen means positioned substantially coincident with the target virtual image. The detector screen is disclosed as a retroreflective screen. Indications of hits are reflected back to the eye of the person firing the simulated weapon. The beam also has sufficient spread such that an instructor standing close to the trainee can observe the hit or miss on the screen. Therefore, the Mohon reference discloses that an indication of the location of a hit will appear on the screen. In addition, the Mohon reference discloses that indications of hits may be displayed on an indicator means separate from the detector screen.

Some target boards use a simple reflective system that reflects a beam, such as a light beam, back to the shooter. The system disclosed in the Myllyla et al. reference, for example, uses a reflector system typical of this type of reflective system.

Another type of target board uses sound and/or motion to indicate that the target has been hit by a beam. The system disclosed in the Gallagher reference is a typical example of this type of sound/motion system.

None of the known target systems provide detailed information as to the size of the beam, the shape of the beam, and what portion of the beam has hit the target.

BRIEF SUMMARY OF THE INVENTION

The present invention may incorporate or be used with a beam emitter such as that set forth in U.S. Pat. Nos. 5,716,216 and 6,068,484, both of which are owned by the assignee of the present invention. Alternative beam emitters may be used.

The pattern testing board of the present invention provides an immediate informative response to a shooter of a beam emitter regarding the size of the beam, the shape of the beam, and what portion of the beam has hit the target testing board.

A pattern testing board of the present invention is able to detect an emission beam such as a laser or light beam from a shooting system. The pattern testing board includes a plurality of paired emission beam sensors and hit indicators. Each emission beam sensor is responsive to a detected emission beam and each hit indicator signals the sensing of the emission beam by the associated emission beam sensor.

Pursuant to a separate preferred aspect of the present invention, multiple pattern testing boards may be mounted together to provide a larger target array or system.

Further, an overlay may be positioned in front of a singular pattern testing board or in front of the array of boards. The overlay may have one or more representations thereon depicting, for example, a silhouette or facsimile of a human, an animal, a bird, a shooting clay, or an alternate target. The overlay may include special markings or colors to indicate specific "kill" zones.

Still further, a moving image display system or a reflective moving image display system may be positioned in front of a singular pattern testing board or in front of an array of pattern testing boards. These display systems are light permeable to allow an emission beam to pass through and to allow viewing of the lit IC/amplifier/LED circuits.

Finally, the pattern testing board may be incorporated in a unique target system that includes the pattern testing board for determining the beam pattern emitted by the beam emitter, a level selection board for selecting a level of play, and a targeting game board having a plurality of targets. The targeting game board may have a plurality of separate targets thereon that randomly indicate an active state and, when hit by a beam of light, indicate a hit state.

The foregoing and other objectives, features, and advantages of the invention will be more readily understood upon consideration of the following detailed description of the invention, taken in conjunction with the accompanying drawings.

DETAILED DESCRIPTION OF THE INVENTION

Figure 1:
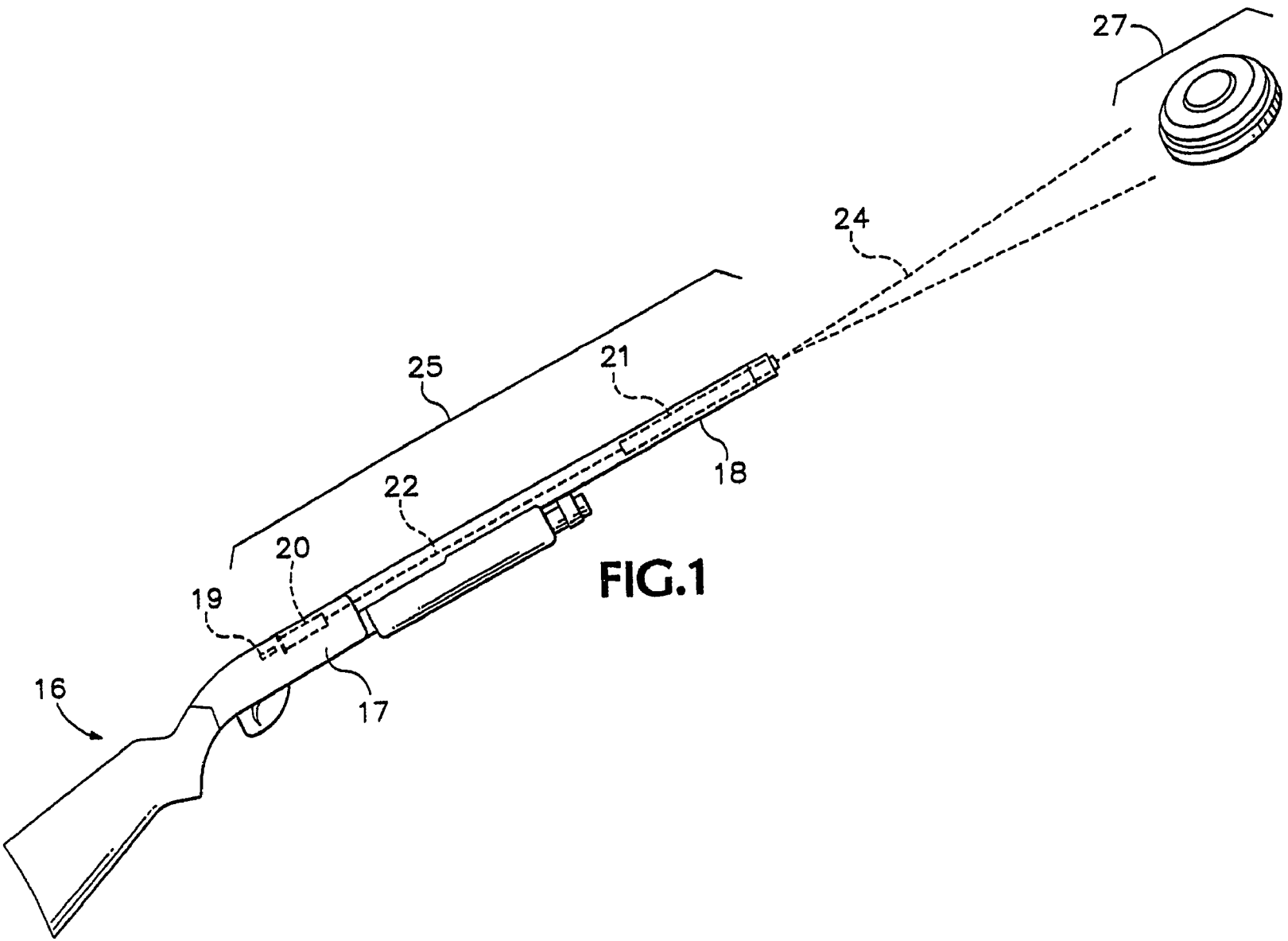
FIG. 1 is a plan diagram of a system for simulating shooting sports including a transmitter system and a receiver system.
Figure 2A:
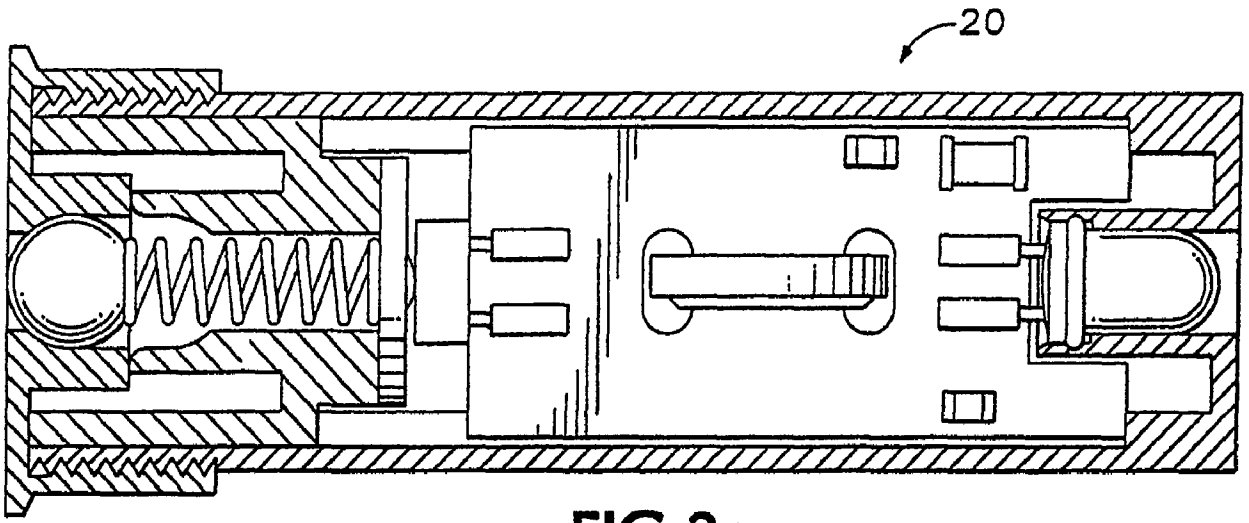
FIG. 2*a* is a cross-sectional side view of a beam cartridge.
Figure 3:
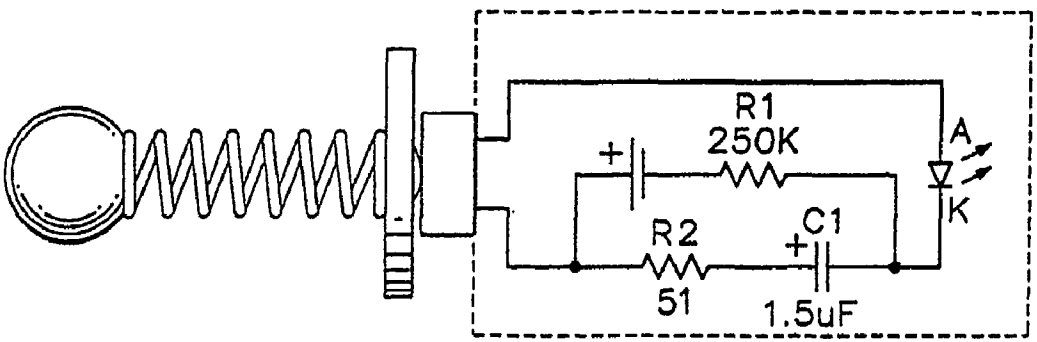
FIG. 3 is a diagram of the mechanical and electronic circuitry of the beam cartridge.
Figure 2B:
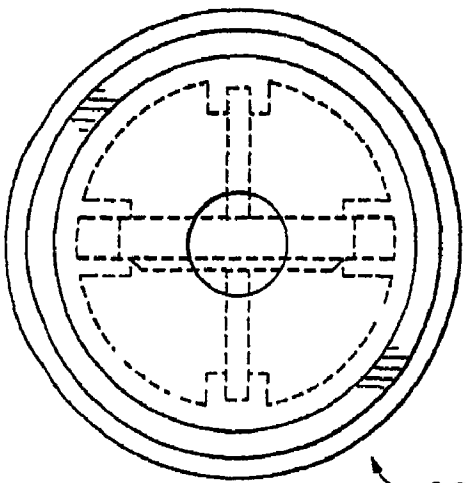
FIG. 2*b* is a cross-sectional front view of a beam cartridge.
Figure 4:
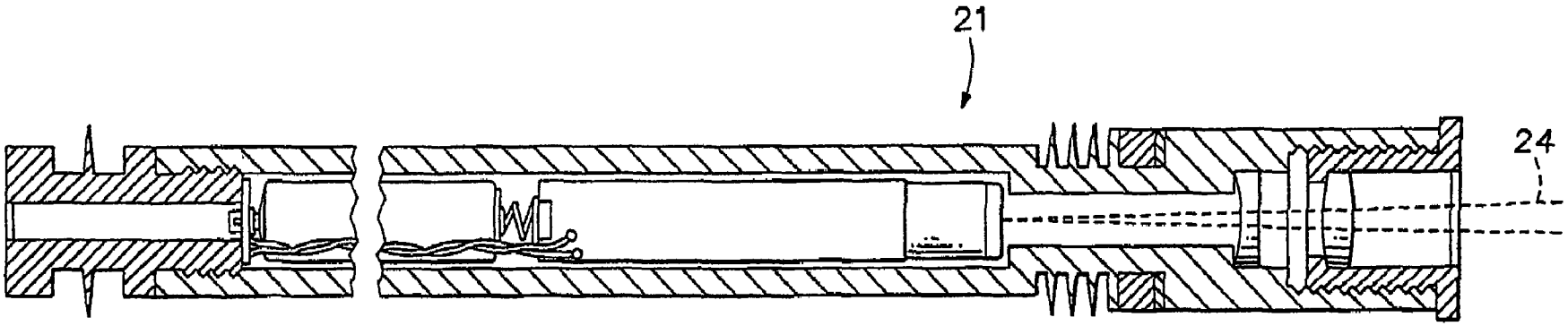
FIG. 4 is a cross-sectional side view of a beam choke including a variable choke grip.
Figure 5:
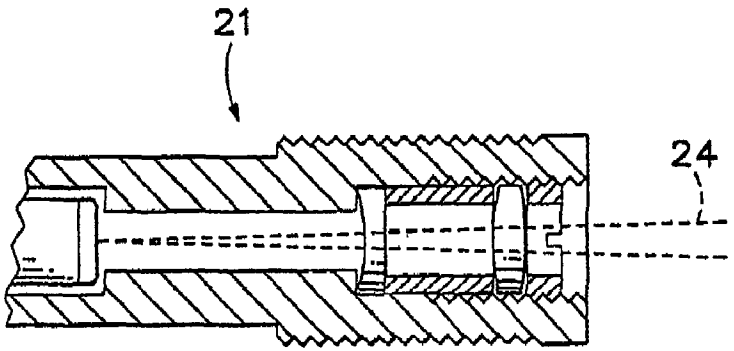
FIG. 5 is a cross-sectional side view of an alternate embodiment of the lens system.

For the purpose of providing a background for the present invention, the system for simulating shooting sports described in U.S. Pat. Nos. 5,716,216 and 6,068,484 is summarized below. Both patents are assigned to the assignee of this application and are incorporated by reference herein. Reference numerals used in the previous applications have been maintained for consistency, however, for the purpose of brevity, some of the figures have been omitted.

As shown in FIG. 1, a system for simulating shooting sports includes a non-projectile transmitter system 25 and a self-contained receiver system 27. The transmitter system 25 is retrofittable to any standard firearm 16 having an ammunition chamber 17, a barrel 18, and a firing pin 19.

The transmitter system 25, as detailed in FIGS. 2-5, preferably includes an actuating beam (or wave) cartridge 20 and an adjustable beam (or wave) choke 21. The beam cartridge 20 has dimensions substantially identical to the dimensions of standard projectile or shot cartridges and therefore fits into the ammunition chamber 17 of a standard firearm 16. The beam choke 21 is adapted to fit into the barrel 18 of a standard firearm 16. When a firearm 16 is "fired," the firing pin 19 strikes the beam cartridge 20 which emits a first or actuating beam (or wave) 22 (shown in phantom in FIG. 1) which may be any electromagnetic beam, but is shown as a beam of light. The actuating beam 22 activates the beam choke 21 which emits a second or emission beam (or wave) 24 (shown in phantom in FIG. 1) which may be any electromagnetic beam, but is shown in one embodiment as a laser beam and in another embodiment as a beam of light. Use of the actuating beam 22 as a link between the beam cartridge 20 and the beam choke 21 facilitates the use of the system with firearms of most barrel lengths.

Although the transmitter system 25 of the simulation system may be used with a self-contained receiver system 27, a pattern testing board 300, as shown in FIGS. 6-9, was originally contemplated as an auxiliary component of the simulation system. The pattern testing board 300 described in U.S. patent application Ser. No. 09/019,152 and U.S. Pat. No. 5,716,216 can detect and display the actual pattern of the emission beam 24 emanating from the beam choke 21. By displaying the actual beam pattern, firearm operation and shot pattern can be verified. To do this, the pattern testing board 300 is placed at a distance of 35 yards from the shooter either behind the target catch net or to the side. One or more shooters can sight and shoot at the pattern testing board 300. The pattern testing board 300 will display a pattern representative of the shape of the emission beam 24 at, for example, 35 yards.

Figure 7:
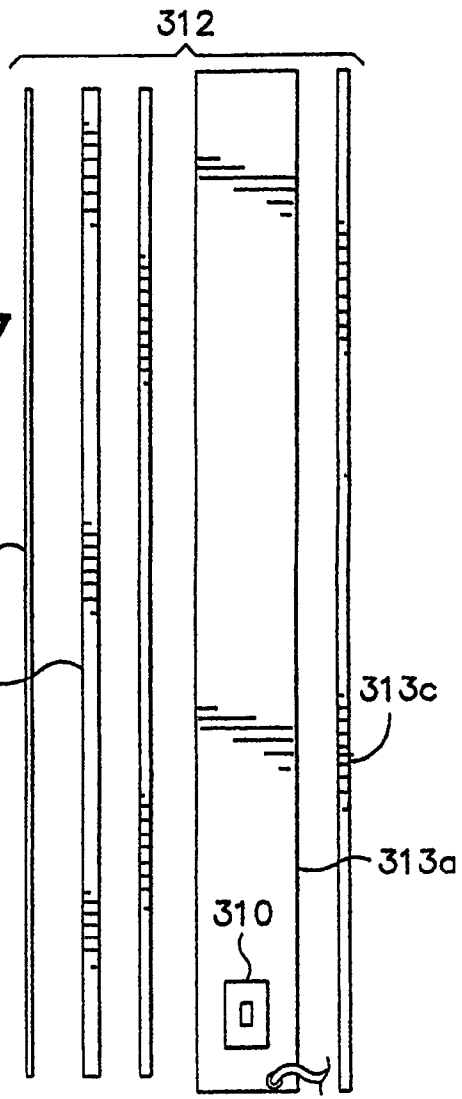
FIG. 7 is an exploded side view of the pattern testing board.
Figure 6:
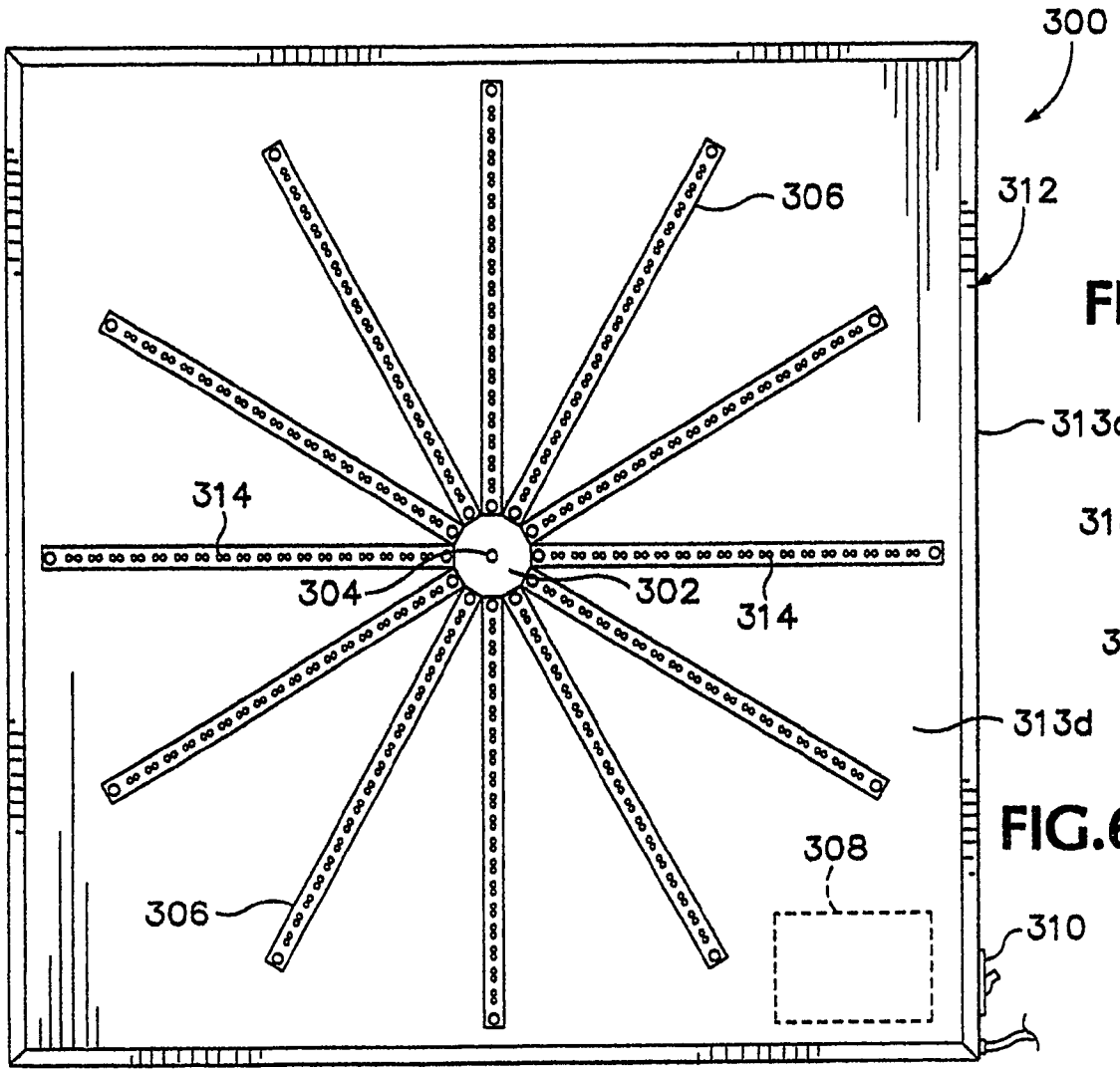
FIG. 6 is a front plan view of a pattern testing board.
Figure 8:
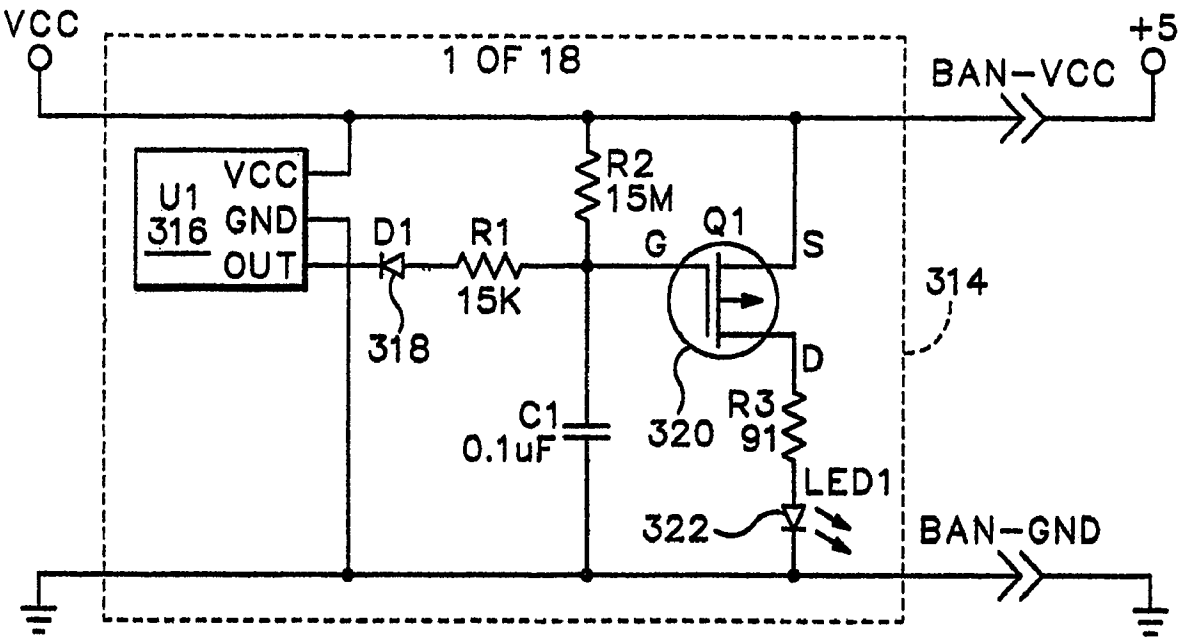
FIG. 8 is a circuit diagram of an infrared detection IC/amplifier/LED circuit on the box PWB.
Figure 9:
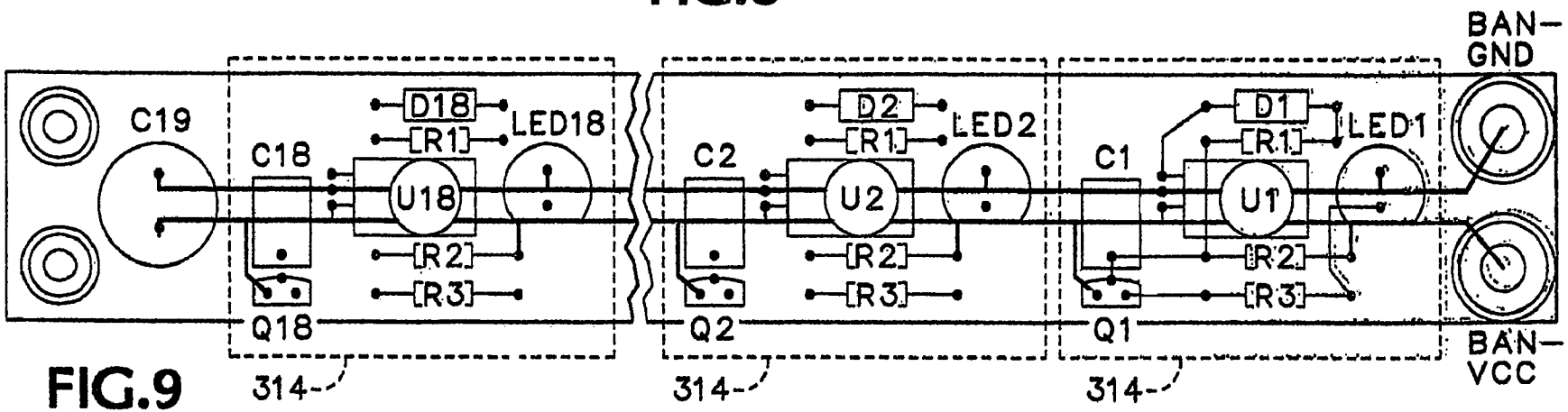
FIG. 9 is a partial simplified diagram of a box printed wiring board of the pattern testing board.

As shown in FIGS. 6-7, one preferred embodiment of the pattern testing board 300 consists of a central target disk 302 with central box LED 304, a plurality of box printed wiring boards (PWBs) 306 which, in this embodiment, are arranged radially around the box LED 304, a power source 308, an ON/OFF switch 310, and an enclosing case 312. Each of the box PWBs 306 contain a set (shown as eighteen) of IR detection IC/amplifier/LED circuits 314 (FIG. 8) that are spaced 1" apart. More or less PWBs may be used on a board and the spacing may be adjusted.

An exemplary case or housing 312 of the pattern testing board 300 is shown in FIG. 7. The housing 312 may be constructed of any sturdy building material such as wood or metal. The example shown includes case components such as an exterior frame 313*a*, an inset panel 313*b* for mounting the box PWBs 306 and central target disk 302, a back cover 313*c*, as well as additional braces. The pattern testing board 300 may also include a polycarbonate front sheet 313*d* to protect the electronic circuitry from damage.

As shown in the exemplary embodiment of FIGS. 6 and 7, a power source 308 (shown in phantom) that is connected to conventional 120 $V_{AC}$ power may be mounted on the inside, bottom of the pattern testing board 300. Each of the box PWBs 306, that are preferably spaced radially about a central box LED 304, are each electrically connected to the power source 308. Preferably, the central target disk 302 is also connected to the power source 308 so that the central box LED 304 is illuminated when the pattern testing board 300 is receiving power. The illuminated central box LED 304 also draws the shooter's attention to the center of the pattern testing board 300. As shown in FIG. 6, the array pattern is 40" in diameter and has 216 detection sites. Larger or smaller array patterns are contemplated in the scope of this invention. The ON/OFF switch 310 may be a conventional wall switch or other toggle device that is mounted on the side of the housing 312.

When a beam detection IC/amplifier/LED circuit 314 is illuminated by an emission beam 24 pulsing at a predefined rate for a duration of 1 to 8 milliseconds, the associated LED lights up for a duration of approximately 2 seconds. Both the duration of the pulse and the duration the LED remains lit are exemplary and, in one embodiment, may be adjustable. The resulting display of lit LEDs indicates the location and pattern of the emission beam 24 on the pattern testing board 300. Each of the box PWBs 306 includes a set of beam detection IC/amplifier/LED circuits 314 such as those shown in FIG. 8. As shown, each circuit 314 includes a photo IC (U1) 316 which is a high sensitivity, photo diode, and band-pass amplifier in a single integrated circuit package that is sensitive to the emission beam 24.

Turning to the exemplary electronics, when the output of U1 316 is High (not illuminated), diode D1 318 is non-conducting, P channel MOSFET (Q1) 320 is non-conducting, C1 has been charged to $V_{CC}$ by R2, and Q1 drain (D), R3, and LED1 are at ground potential. When the output of U1 316 goes Low (illumination detected), D1 318 conducts which brings the D1 anode junction with R1 to about 1 volt above ground. If the output of U1 316 remains Low, the voltage across C1 decreases from $V_{CC}$ to +1 volt. As the voltage across C1 decreases, the source-to-gate voltage of Q1 320 increases causing Q1 320 to conduct when the voltage difference exceeds 2 volts. With the Q1 source at +5 volts and the Q1 gate at +1 volt, Q1 source-to-drain (D) resistance appears to be under 10 ohms. With Q1 320 conducting, R3 will pull LED1 322 anode High until LED1 322 begins conducting at +1.6 volts. LED1 322 will remain illuminated as long as U1 316 output is Low. When U1 $V_{out}$ returns to High, D1 318 becomes reversed biased and ceases to conduct. However, the voltage across C1 proceeds to increase from +1V to $V_{cc}$ due to the current supplied by R2. As the voltage across C1 increases the gate-to-source voltage of Q1 320 decreases. Q1 source-to-drain resistance increases until Q1 320 ceases to conduct depriving LED1 322 of all illumination. R2 and C1 form a time constant of about 1.5 seconds resulting in current flow through LED1 322 for about 2 seconds after U1 $V_{out}$ goes High. This procedure causes LED1 322 to remain visible for a predefined time period, such as 2 seconds, after being triggered. Other features of the circuitry include the fact that R1 and C1 form a low pass filter to reject quick, short duration excursion of $U1_{out}$ Low caused by noise. R1 also limits the surge in current that would occur if D1 318 were directly connected to C1.

Figure 10:
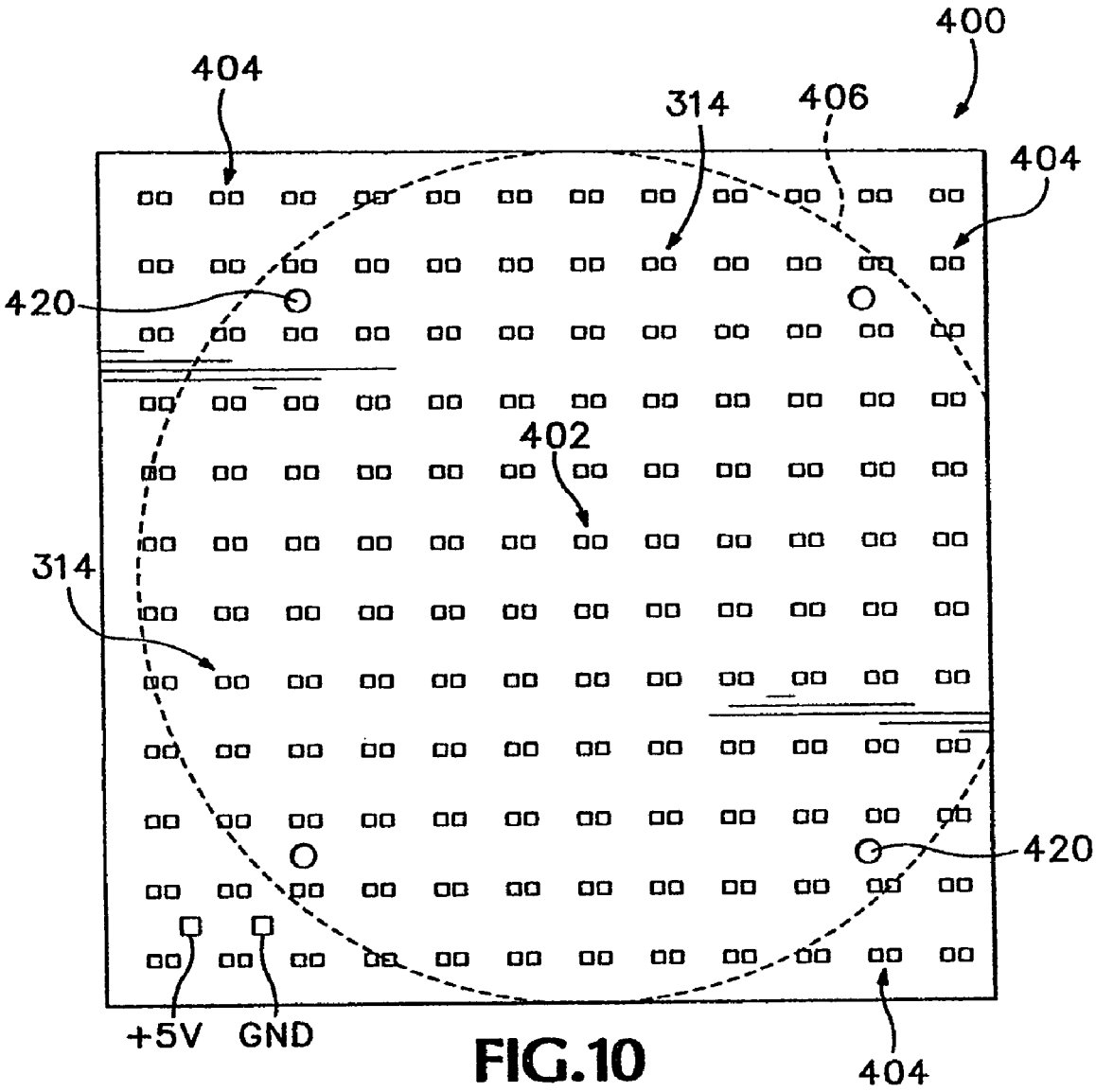
FIG. 10 is a front plan view of an alternate pattern testing board.
Figure 11:
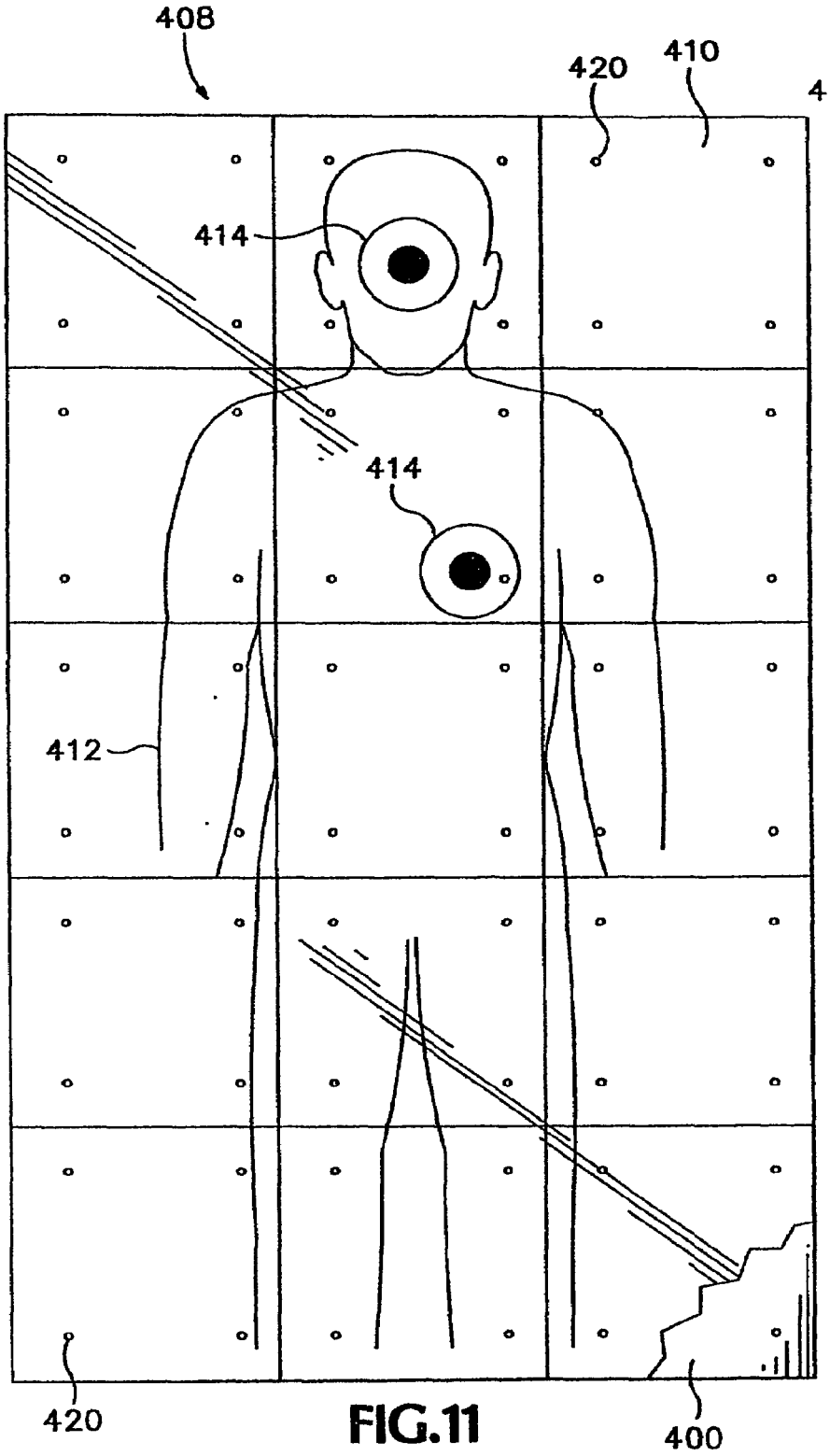
FIG. 11 is a front plan view of an array of pattern testing boards with an overlay thereover.
Figure 12:
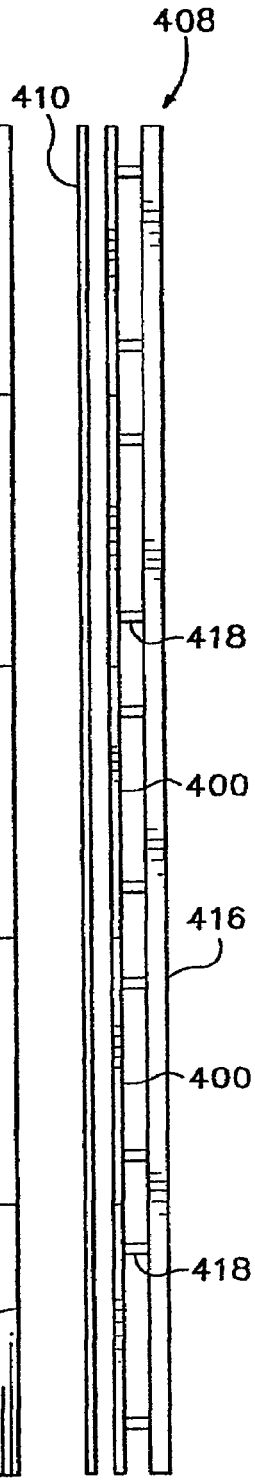
FIG. 12 is a side view of the array and overlay of FIG. 11.

FIGS. 10-12 show a separate preferred aspect of the pattern testing board 400. This alternate pattern testing board 400, like pattern testing board 300, can detect and display the actual pattern of the emission beam 24 emanating from the beam choke 21. By displaying the actual beam pattern, firearm operation and shot pattern can be verified. To do this, the pattern testing board 400 is placed at a distance from the shooter either behind the target catch net or to the side. One or more shooters can sight and shoot at the pattern testing board 400. The pattern testing board 400 will display a pattern representative of the shape of the emission beam 24 at 35 yards. These distances are meant to be exemplary and not to limit the scope of the invention.

As shown in FIG. 10, the alternate preferred embodiment of the pattern testing board 400 consists of an array of IC/amplifier/LED circuits 314 (shown as a 12×12 array) spaced 1" apart. The array may be created by mounting, for example, twelve (12) box printed wiring boards (PWBs), such as those shown in FIGS. 6 and 9, vertically or horizontally. If each PWB had twelve IC/amplifier/LED circuits 314, a 12×12 array would be produced. Alternately, 144 IC/amplifier/LED circuits 314 may be mounted separately to produce the 12×12 array. It should be noted, of course, that the array may be of any size or dimension, the spacing may be changed, and alternate shapes are contemplated.

When a beam detection IC/amplifier/LED circuit 314 is illuminated by an emission beam 24 pulsing at a predefined rate for a duration of 1 to 8 milliseconds, the associated LED lights up for a duration of approximately 2 seconds. The resulting display of lit LEDs indicates the location and pattern of the emission beam 24 on the pattern testing board 400. As set forth above, the pulse duration and the duration the LEDs remain lit are exemplary and, in one embodiment, may be adjustable.

The housing, power source, and ON/OFF switch of the alternate pattern testing board 400 may be identical to that shown in FIG. 7 or may be a variation thereof.

Optionally, if a single alternate pattern testing board 400 is used, one or more central IC/amplifier/LED circuits 402 may be constantly illuminated while the pattern testing board 400 is receiving power. The illuminated IC/amplifier/LED circuits 402 indicate that the board 400 is receiving power and draw the shooter's attention to the center of the pattern testing board 400. The constantly illuminated central IC/amplifier/LED circuits 402 may be in a pattern such as a "+."

Further, if a single alternate pattern testing board 400 is used, exterior IC/amplifier/LED circuits 404 outside a predetermined circular area 406 may optionally be deactivated or blocked by an opaque cover. Blocking the exterior IC/amplifier/LED circuits 404 conveys the appearance that the emission beam 24 is circular to the shooter. Although emission beams 24 are not always circular, it is sometimes desirable to enforce this illusion.

FIGS. 11 and 12 show a multiple pattern testing board array or system 408. Although the system 408 is shown as an array of fifteen pattern testing boards 400, the system may be of any size or dimension. The system provides a large target testing pattern that is of a size sufficient to accommodate a representation of a silhouette or facsimile of a human, an animal, a bird, a shooting clay, or other desired target. The pattern testing boards 400 in the system 408 are preferably electrically interconnected. Also, if used in a system, preferably the boards would not have illuminated central IC/amplifier/LED circuits 402 or blocked or deactivated exterior IC/amplifier/LED circuits 404. In this manner, a uniform system 408 of approximately 1" resolution is created. By adjusting the spacing of the circuits 314, the sensitivity may be adjusted.

Further, an overlay 410 may be used with a representation 412 thereon. The overlay is preferably a substantially clear sheet of plastic or other clear material that allows the emission beam 24 to pass through and the shooter to view the illuminated IC/amplifier/LED circuits 314. The overlay 410 may be suspended in front of the array 408 or may be attached directly thereto. A removable overlay 410 would allow the option of changing the representation 412 to depict alternate targets.

The representation 412 may depict a silhouette or a facsimile of a human, an animal, a bird, a shooting clay, or an alternate target. The overlay 410 may also include special markings or colors to differentiate specific "kill" (or "wound") zones 414 within the representation 412.

Figure 13:
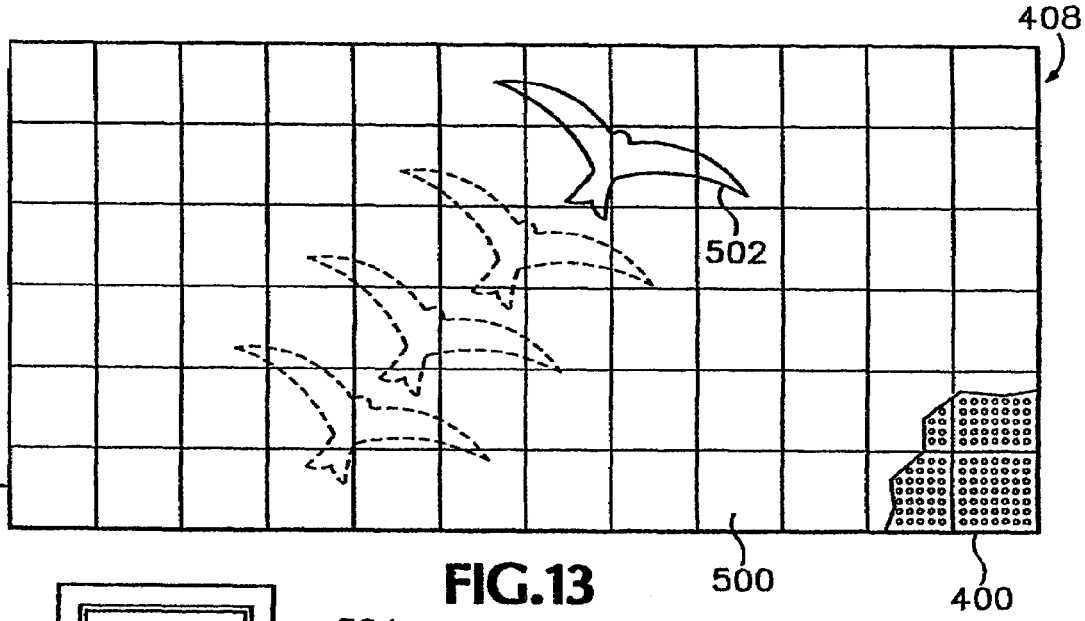
FIG. 13 is a front plan view of an array of platform testing boards with a preferred embodiment of a moving image display system thereover.

FIG. 13 shows the multiple pattern testing board array 408 positioned behind a moving image display system 500 capable of displaying light permeable static or moving images 502. The images 502 may be generated by a computer 504. Like the overlay 410, the emission beam 24 passes through the display system 500 to activate the IC/amplifier/LED circuits 314. Because the display system 500 is light permeable, the shooter can view the lit IC/amplifier/LED circuits 314 to determine the accuracy of his hit.

Figure 14:
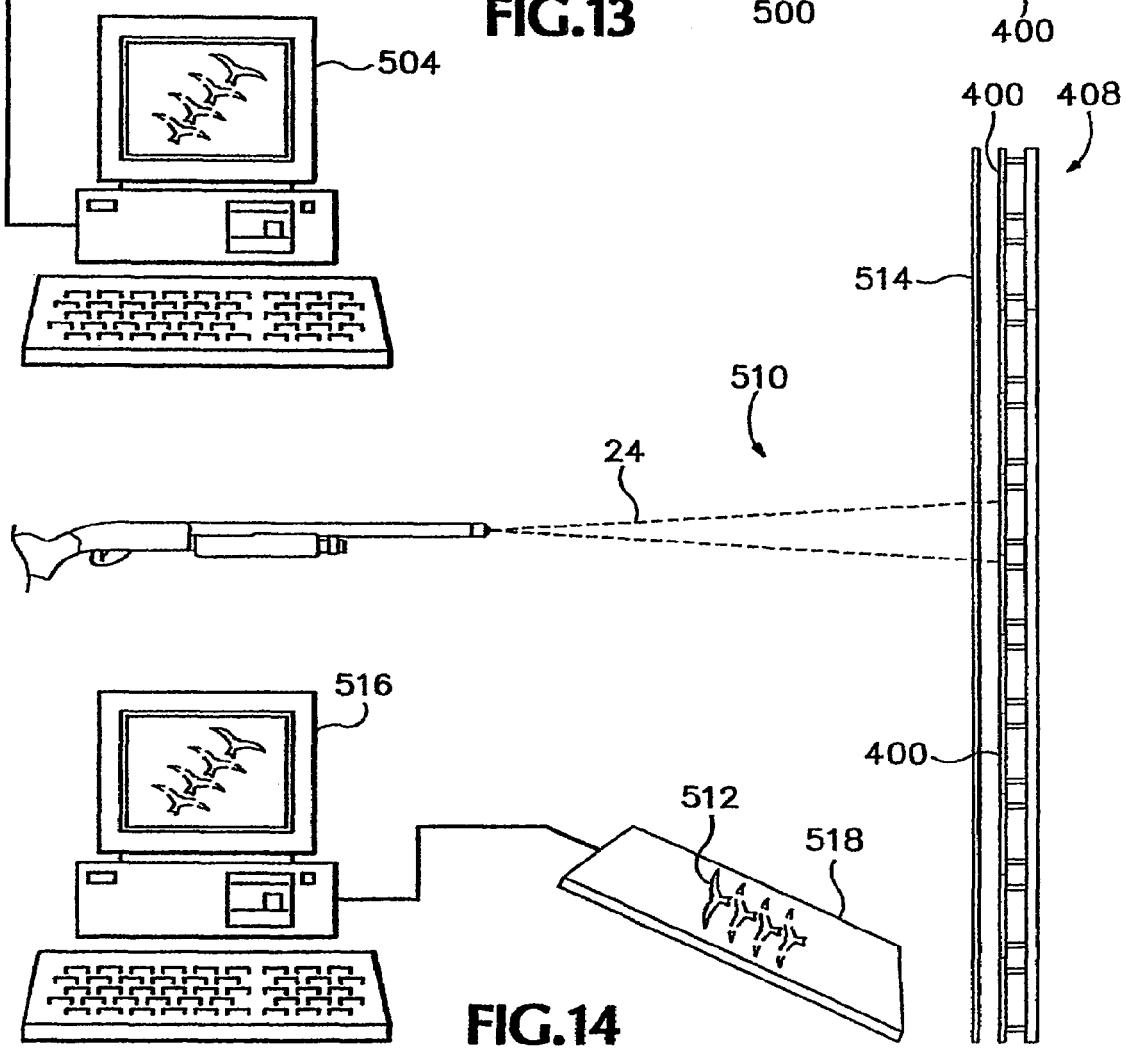
FIG. 14 is a side plan view of an array of pattern testing boards with a preferred embodiment of a reflective moving image display system thereover.

FIG. 14 shows a reflective moving image display system 510 that is positioned in front of the multiple pattern testing board array 408. The reflective system 510 is capable of displaying static or moving light permeable images 512 on a reflective, light permeable display 514. The reflective display 514 may be a sheet of glass. The images 512 could be generated by a computer 516 and displayed on a display screen 518. The images 512 on the display screen 518 are then reflected onto the reflective display 514. The emission beam 24 passes through the reflective display 514 to activate the IC/amplifier/LED circuits 314. Because the reflective display 514 is light permeable, the shooter can view the lit IC/amplifier/LED circuits 314 to determine the accuracy of his hit.

The system 408 may be constructed by mounting the pattern testing boards 400 to a frame structure 416 using attachment apparatus 418 such as screws or mounting posts. The frame structure 416 may be a back board, metal bars, or other suitable sturdy structure. Each board 400 may include one or more mounting holes 420 through which the attachment apparatus 418 is inserted. Alternatively, the boards 400 may be equipped with interlocking structure or may be mounted together, with or without a frame structure, using traditional means such as glue or mounting tape.

Figure 15:
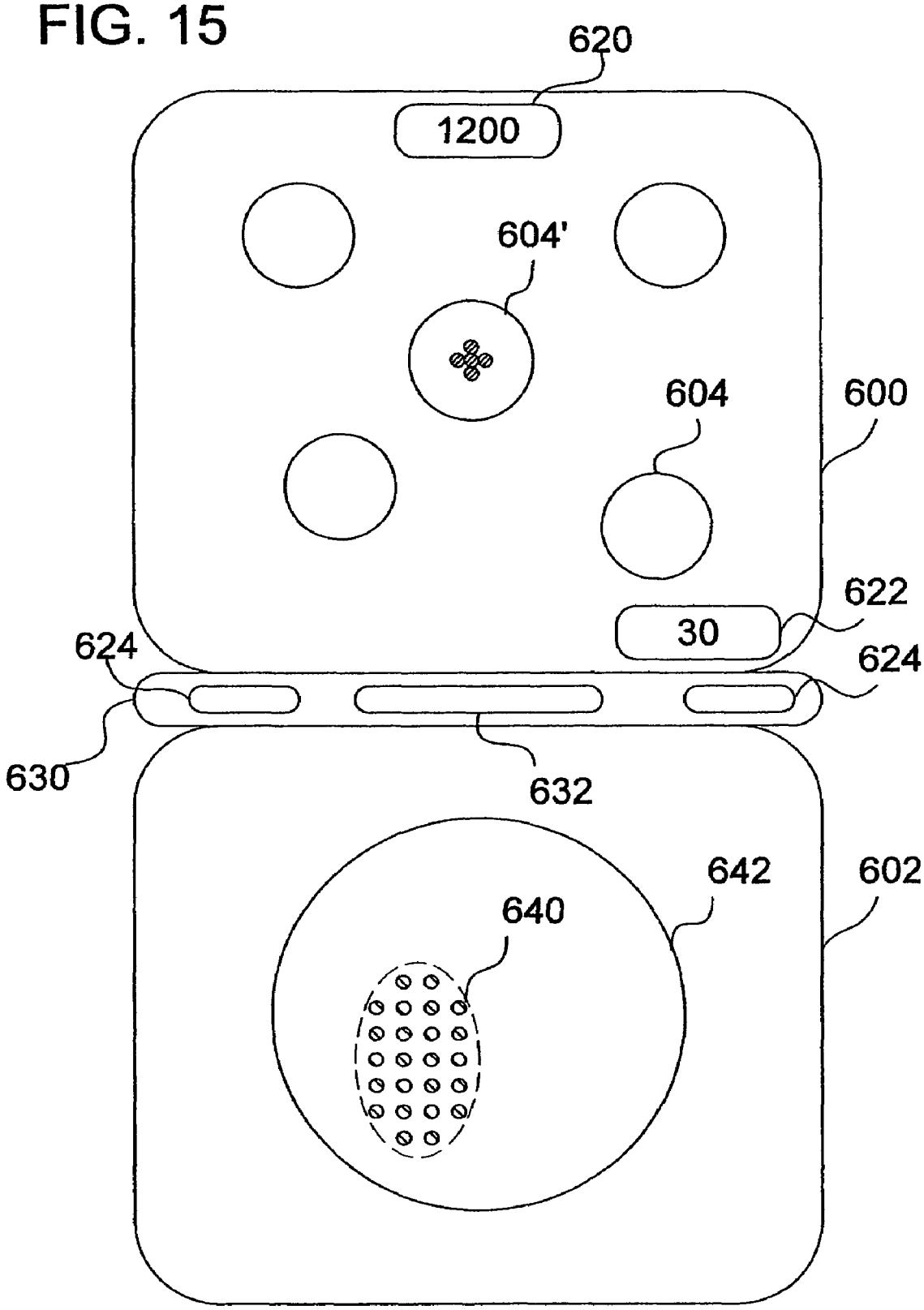
FIG. 15 is a front plan view of an exemplary system incorporating a targeting game board and the pattern testing board of the present invention.
Figure 16:
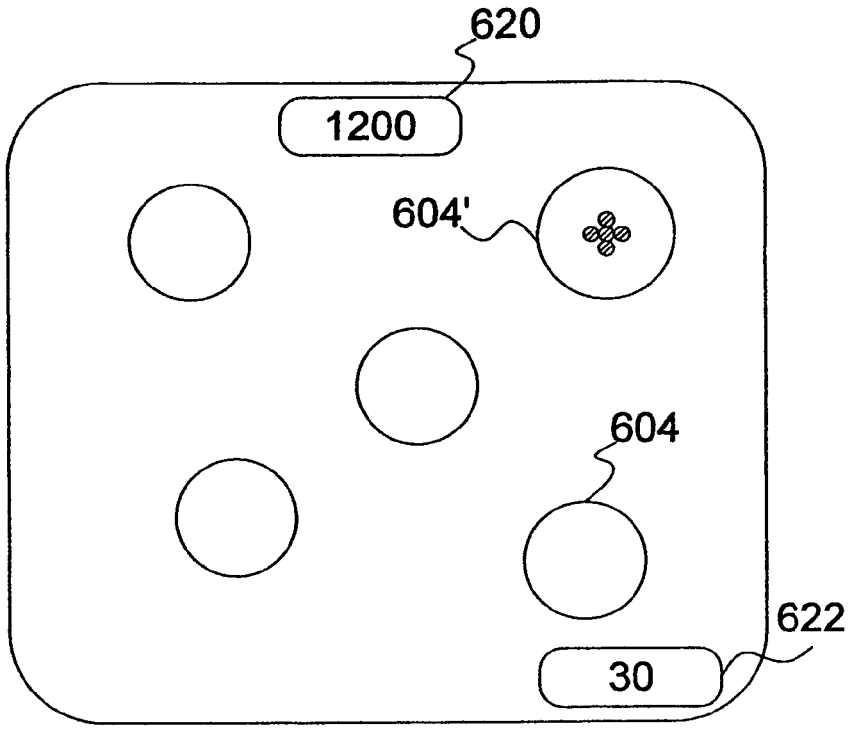
FIGS. 16 and 17 are front plan views of an exemplary targeting game board of the system of FIG. 15.
Figure 17:
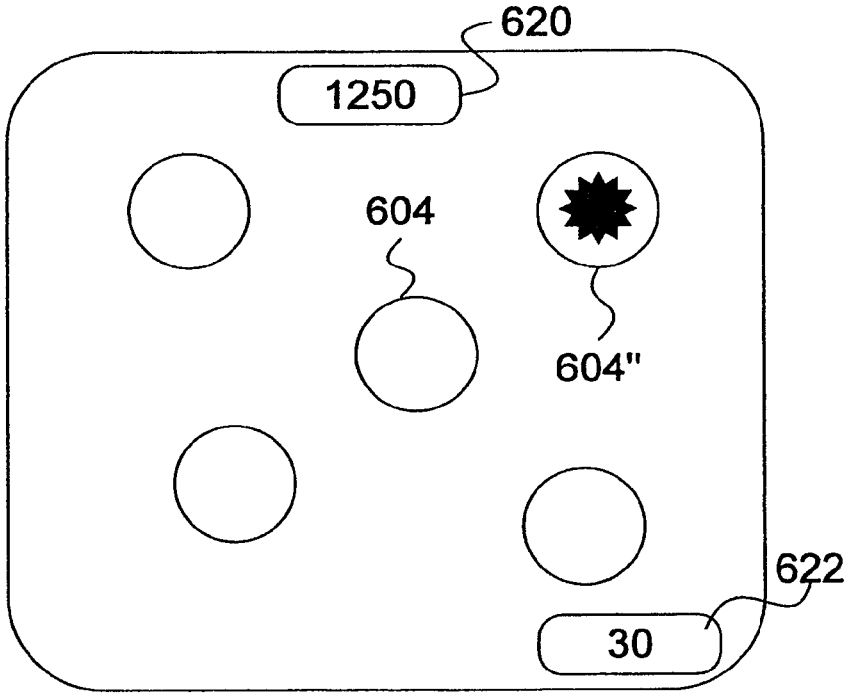
Figure 18:
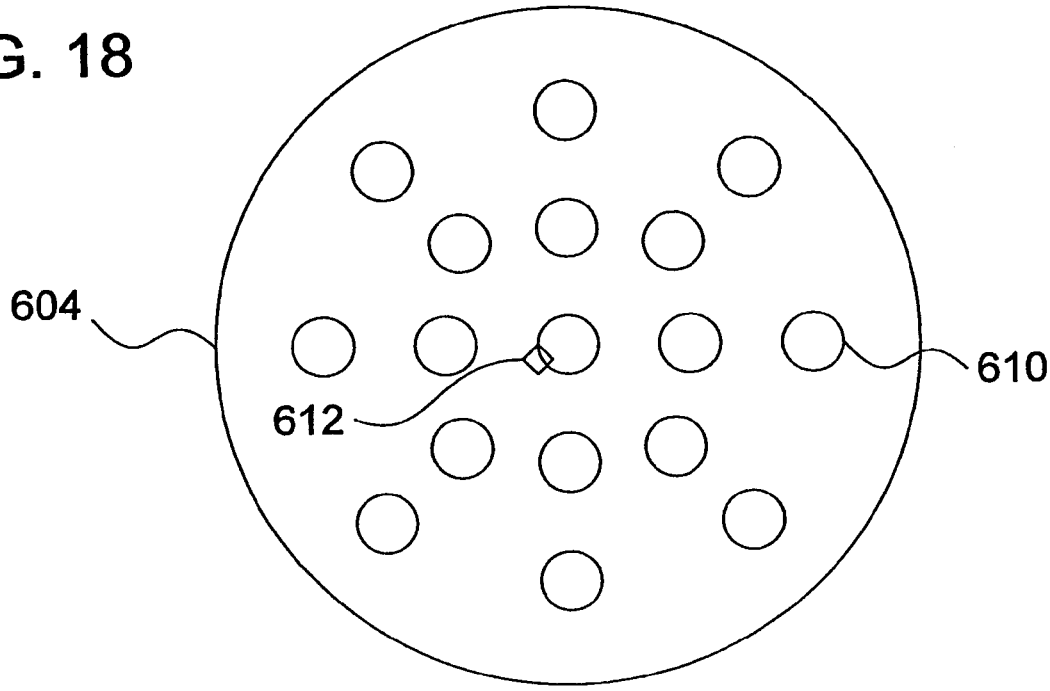
FIGS. 18-21 are front plan views of exemplary targets of the exemplary targeting game board of FIGS. 16 and 17.
Figure 19:
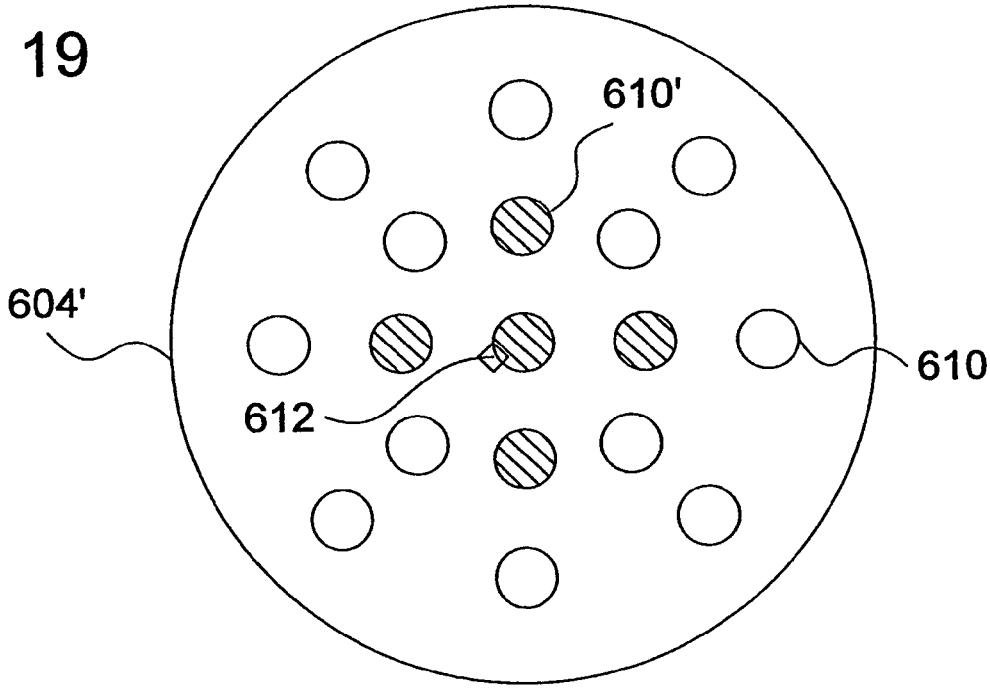

FIG. 15 shows an exemplary system incorporating a targeting game board 600 and the pattern testing board 602 of the present invention. The pattern testing board 602 works in substantially the same manner as discussed above providing an immediate informative response to a shooter of a beam emitter regarding the size of the beam, the shape of the beam, and what portion of the beam has hit the target testing board. FIGS. 16 and 17 detail an exemplary targeting game board 600 that may be used with the system of FIG. 15. Exemplary targets 604 of the exemplary targeting game board 600 are detailed in FIGS. 18-21.

The exemplary targeting game board 600 has a unique board (FIGS. 16 and 17) with a plurality (shown as 5) of separate targets (reference numeral 604 will designate targets in general as well as targets in the dormant state as discussed below). Although this targeting game board 600 will be discussed in terms of a system (FIG. 15), it should be noted that the targeting game board 600 could stand alone.

Figure 20:
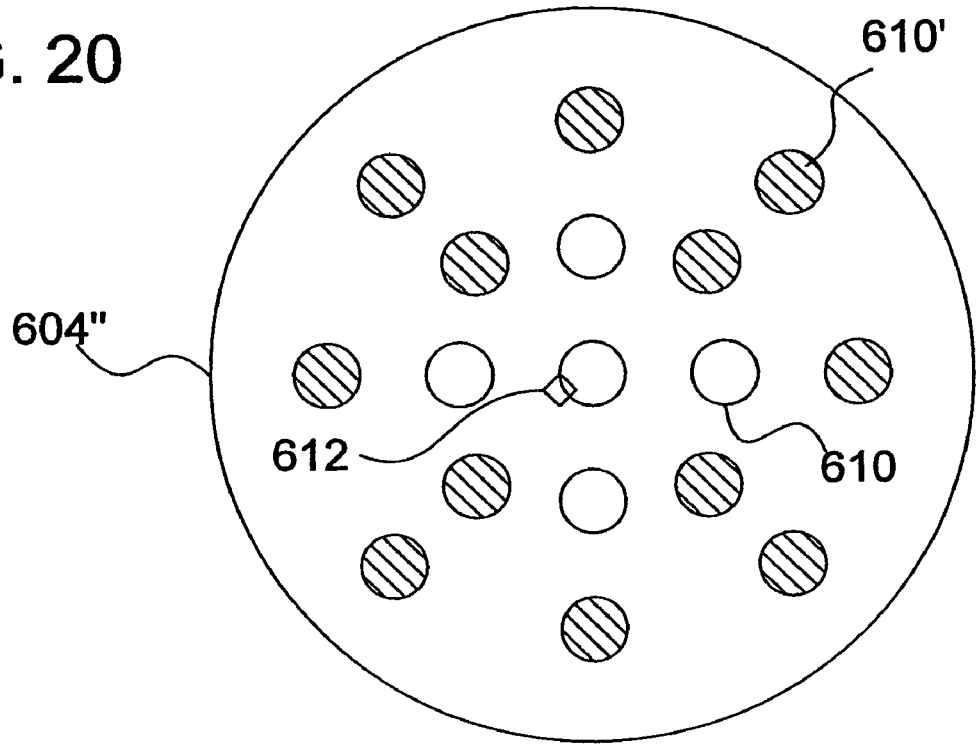
Figure 21:
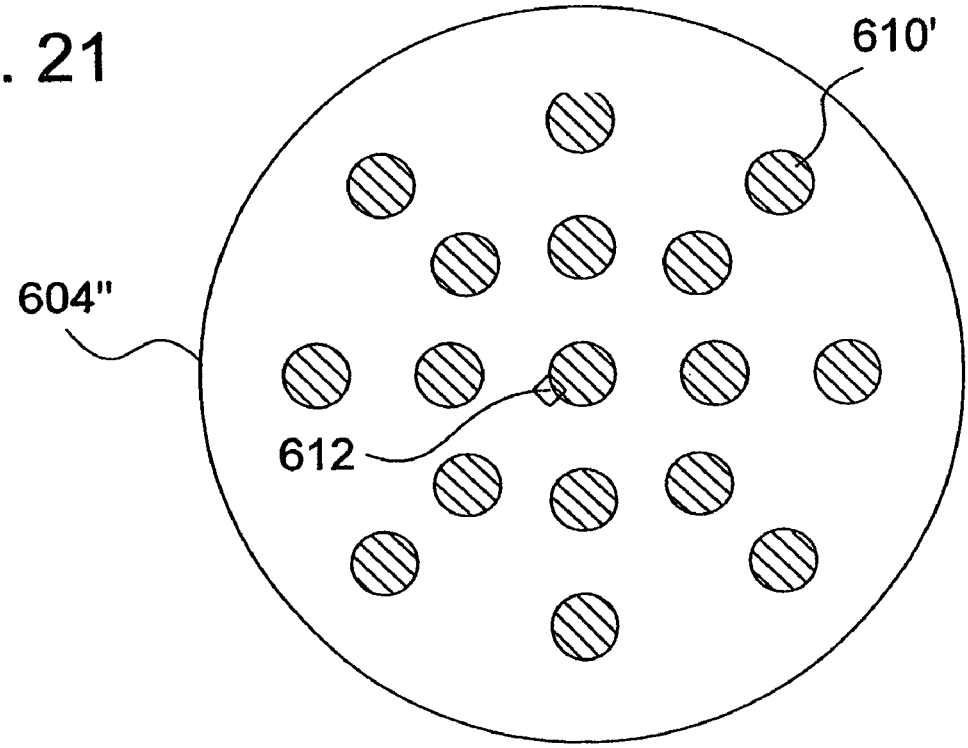

As shown in FIGS. 18-21, each target 604 has a plurality of lights 610 (LEDs) and at least one receiver 612 (preferably set back and/or slightly tucked behind a light to limit the angles from which a beam could be detected). Using the lights 610 to indicate its status, each target has at least three states: dormant 604 (FIG. 18), active 604' (FIG. 19), and hit 604" (FIGS. 20 and 21). In the dormant state, the all or most of the lights 610 of the target 604 are off. In the active state, a few of the lights 610' of the target 604 are on. In the hit state, the all or most of the lights 610' of the target 604" are on. The specific patterns or representations of the states may vary from those shown and described without affecting the scope of the invention.

Most of the time the targets 604 are dormant. When the game begins, the targets 604' enter the active state at random. If the activated target 604' is "hit" by a predetermined type of beam (preferably a light beam), the target 604" enters the hit state for a predetermined period of time followed by the dormant state. If the activated target 604' is not "hit," after a predetermined period of time the target 604 enters the dormant state. Alternatively, the target 604' may remain in the active state until it is "hit."

In one preferred embodiment of the exemplary targeting game board 600, a score indicator 620 and a timer 622 are also included. The system may incorporate sound (emitted, for example, from the sound speakers 624) to indicate hits. The targets 604 may be of the same or different sizes. The targets 604 may have the same point value or may have different point value based on size, location, or activation time period. The targeting game board 600 may also incorporate moving targets.

A system such as that shown in FIG. 15 might have three sections, a targeting game board 600, a level selection board 630 (with a level selector 632 thereon), and a pattern testing board 602. The targeting game board 600 might be as described above or it might be an alternative targeting game board 600. The level selection board 630 allows a user to select a skill level without having to touch physically the system. In addition, the pattern testing board 602 allows a user to practice with the beam emitter by showing the exact beam pattern 640 of the beam as it intersects with a pattern testing zone 642 of the pattern testing board 602. As set forth above, when a beam sensor senses the presence of a beam, it activates an associated and substantially adjacent beam indicator. The combination of activated beam indicators show the beam pattern 640. As some beam emitters may be adjusted, this would allow the user to adjust the beam and accurately determine the size and/or shape of the beam pattern 640.

In use, the system may be used for a game as follows. First, the user gets the feel of the beam emitter using the pattern testing board 602. Then, the user selects a level either by "hitting" a particular location on the level selection board or by "hitting" the level selection board a certain number of times (i.e. one for beginning, two for intermediate, three for advanced). Then, the user hits a predetermined location on the exemplary targeting game board 600 (such as the central target 604') to initiate the game. At the start of the game, the score indicator 620 indicates a zero score and a timer 622 indicates the time period of the duration of the game. As the game begins, the targets 604' enter the active state at random. If the activated target 604' is "hit" by an emission beam, the score indicator 620 is incremented by the target's point designation and the target 604" enters the hit state for a predetermined period of time followed by the dormant state. If the activated target 604' is not "hit," after a predetermined period of time the target 604 enters the dormant state. Alternatively, the target 604' may remain in the active state until it is "hit." The score indicator 620 may be reduced if the target 604' is not "hit." At the end of the game, the timer 622 indicates that there is no time left and the score indicator 620 indicates a final score. The system may be designed to keep track of high scores, allow multiple users, or otherwise make the game more competitive.

Finally, it should be noted that the pattern testing board and system described above may be used with any system that emits a proper emission beam and, therefore, is not limited to the transmitter system described herein. Suitable beams include, but are not limited to, light beams and laser beams.

The terms and expressions that have been employed in the foregoing specification are used as terms of description and not of limitation, and are not intended to exclude equivalents of the features shown and described or portions of them. The scope of the invention is defined and limited only by the claims that follow.

What is claimed is:

1. A pattern testing board for detecting an emission beam's presence and projected beam pattern, said pattern testing board comprising:

(a) a single emission beam having a projected beam pattern formed by an intersection of said emission beam and a target surface;

(b) a plurality of emission beam sensors responsive to at least a portion of said projected beam pattern, said projected beam pattern being larger than a single emission beam sensor;

(c) a plurality of hit indicators each in communication with and responsive to at least one emission beam sensor, each hit indicator substantially adjacent its associated said emission beam sensor;

(d) each said hit indicator adapted for signaling the sensing of at least a portion of said projected beam pattern by said emission beam sensor; and (e) together said plurality of hit indicators signaling any sensed at least a portion of said projected beam pattern and providing a graphic, visual representation of said any sensed at least a portion of said projected beam pattern.

2. The pattern testing board of claim 1 wherein said hit indicators are illuminated when their associated emission beam sensor senses the presence of said emission beam.

3. The pattern testing board of claim 1 wherein said hit indicators are illuminated when their associated emission beam sensor senses the presence of said emission beam and for an additional predefined period of time thereafter.

4. The pattern testing board of claim 1 wherein an overlay is positioned in front of said pattern testing board.

5. The pattern testing board of claim 1 wherein a moving image display system is positioned in front of said pattern testing board.

6. The pattern testing board of claim 1 wherein a reflective moving image display system is positioned in front of said pattern testing board.

7. The pattern testing board of claim 1 wherein a plurality of said pattern testing boards are arrangeable in an array.

8. A method for detecting and signaling an emission beam's presence and pattern, said method comprising the steps of:

(a) providing a pattern testing board having a plurality of emission beam sensors and a plurality of hit indicators, each said hit indicator substantially adjacent and associated with at least on emission beam sensor;

(b) emitting said emission beam so that it shines on at least one of said emission beam sensors;

(c) sensing the presence of said emission beam with at least one of said emission beam sensors;

(d) signaling the sensing of said emission beam by each said emission beam sensor that senses the presence of said emission beam by activating its associated hit indicator; and (e) signaling the pattern of said emission beam present on said pattern testing board.

9. The method of claim 8 wherein said step of signaling the sensing of said emission beam further comprises the step of signaling the sensing of said emission beam by illuminating a hit indicator.

10. The method of claim 8 wherein said step of signaling the sensing of said emission beam further comprises the step of signaling the sensing of said emission beam by illuminating a hit indicator for an additional predefined period of time thereafter.

11. The method of claim 8 further comprising the step of providing an overlay in front of said pattern testing board.

12. The method of claim 8 further comprising the step of providing a moving image display system in front of said pattern testing board.

13. The method of claim 8 further comprising the step of providing a reflective moving image display system in front of said pattern testing board.

14. The method of claim 8 further comprising the step of arranging a plurality of said pattern testing boards in an array.

* * * * *